US007866846B2

(12) United States Patent
Zheng

(10) Patent No.: US 7,866,846 B2
(45) Date of Patent: Jan. 11, 2011

(54) LED LAMP ASSEMBLY

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 149 days.

(21) Appl. No.: 12/392,084

(22) Filed: Feb. 24, 2009

(65) Prior Publication Data

US 2010/0097805 A1 Apr. 22, 2010

(30) Foreign Application Priority Data

Oct. 17, 2008 (CN) ..... 2008 1 0304983

(51) Int. Cl.
*F21V 21/116* (2006.01)

(52) U.S. Cl. ..... 362/249.02; 362/414

(58) Field of Classification Search ..... 362/217.16, 362/225, 249.02, 414
See application file for complete search history.

(56) References Cited

U.S. PATENT DOCUMENTS

| | | | | |
|---|---|---|---|---|
| 2,352,496 | A * | 6/1944 | Rose | 362/225 |
| 4,167,783 | A * | 9/1979 | Mitchell | 362/414 |
| 6,416,207 | B1 * | 7/2002 | Chang | 362/414 |
| 2002/0172043 | A1 * | 11/2002 | Ching | 362/414 |
| 2003/0174503 | A1 * | 9/2003 | Yueh | 362/414 |
| 2006/0279948 | A1 * | 12/2006 | Tsai | 362/414 |
| 2007/0223239 | A1 * | 9/2007 | Thompson et al. | 362/414 |
| 2009/0303717 | A1 * | 12/2009 | Long et al. | 362/249.02 |

* cited by examiner

*Primary Examiner*—David V Bruce
(74) *Attorney, Agent, or Firm*—Frank R. Niranjan

(57) ABSTRACT

An LED lamp assembly includes a fixing member with a plurality of LED lamps secured to it from different aspects. The fixing member has a plurality of supporting parts extending outwards from a bottom end thereof and a plurality of holding parts extending outwards from an upper end thereof. Each holding part defines an opening therein. The LED lamps are respectively mounted on the holding parts of the fixing member and each comprise a plurality of LED modules received in an opening of a corresponding holding part and facing toward the supporting parts.

11 Claims, 4 Drawing Sheets

LED LAMP ASSEMBLY

BACKGROUND OF THE DISCLOSURE

1. Field of the Disclosure

The disclosure relates to LED (light emitting diode) lamps and, more particularly, to an LED lamp assembly configured as a floor lamp for a street lighting purpose.

2. Description of Related Art

LED lamps utilize LEDs as a source of illumination. LEDs provide resistance to shock and an almost endless lifetime under specific conditions, making them a cost-effective and high quality replacement for incandescent and fluorescent lamps.

Known implementations of LED modules in LED lamps make use of a plurality of individual LEDs to generate sufficient light with satisfactory distribution. However, the great number of LEDs leads to a more expensive module with higher power consumption, leading to increased heat output, which, if not adequately addressed at additional expense, impacts the LED lamp reliability.

A typical LED lamp incorporates a heat dissipating configuration therein, which can dissipate heat generated by the LEDs in a timely manner. However, to meet requirements of heat dissipation with satisfactory illumination, this type of LED lamp at least requires a heat sink, a cover and a connecting base, thereby complicating structure of the overall device. Accordingly, the LED lamp normally requires mounting in a predetermined way; such as only being held in position by a support of an upper end of a fixing rod, when the LED lamp is used as a floor lamp. Alternatively, the LED lamp can be suspended by a lower end of the fixing rod, whereby the LED lamp is used as a hanging lamp. However, with either position, the lamp incorporated with the fixing rod is usually not easily relocated, and usually permanently installed. Thus, the lamps cannot be used in environments requiring varying placements thereof.

What is needed, therefore, is an LED lamp assembly which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
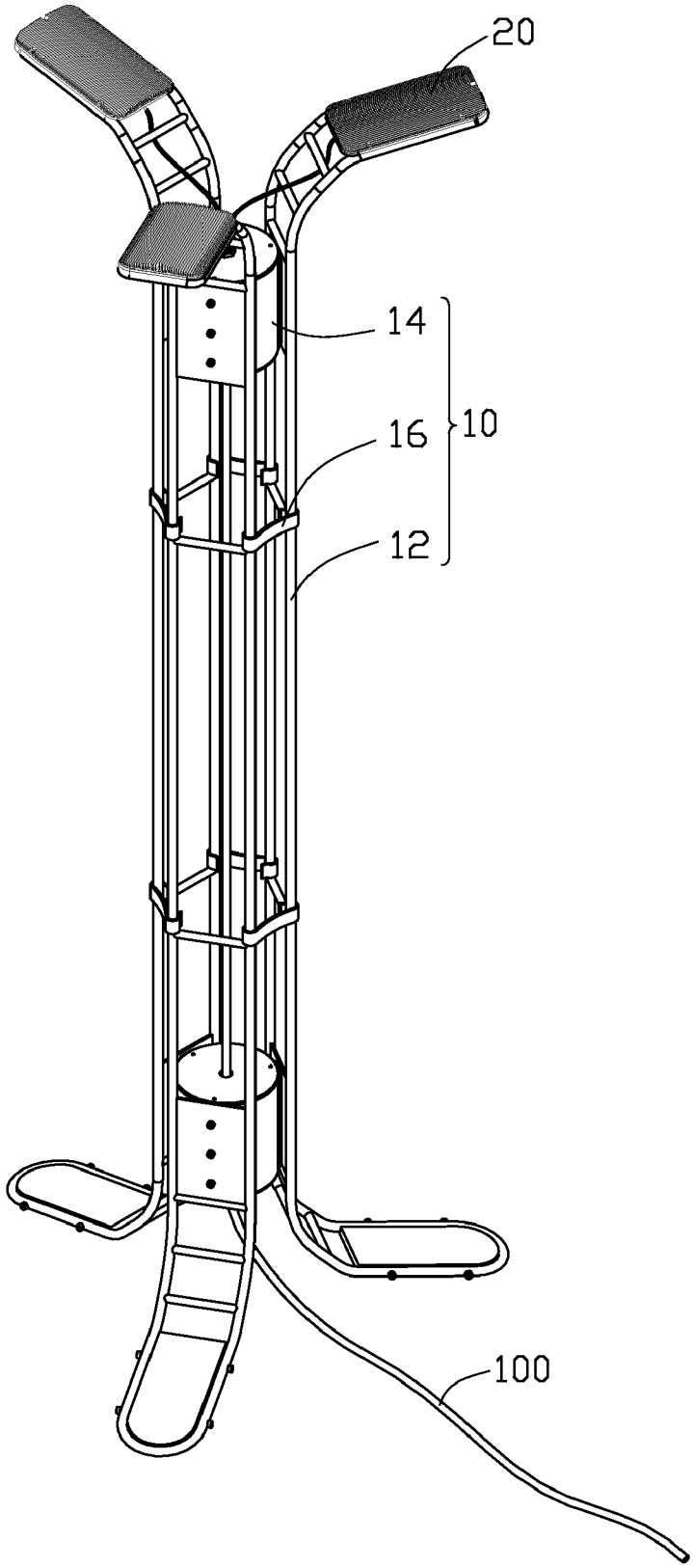
FIG. 1 is an isometric, assembled view of an LED lamp assembly in accordance with an exemplary embodiment of the disclosure.
Figure 2:
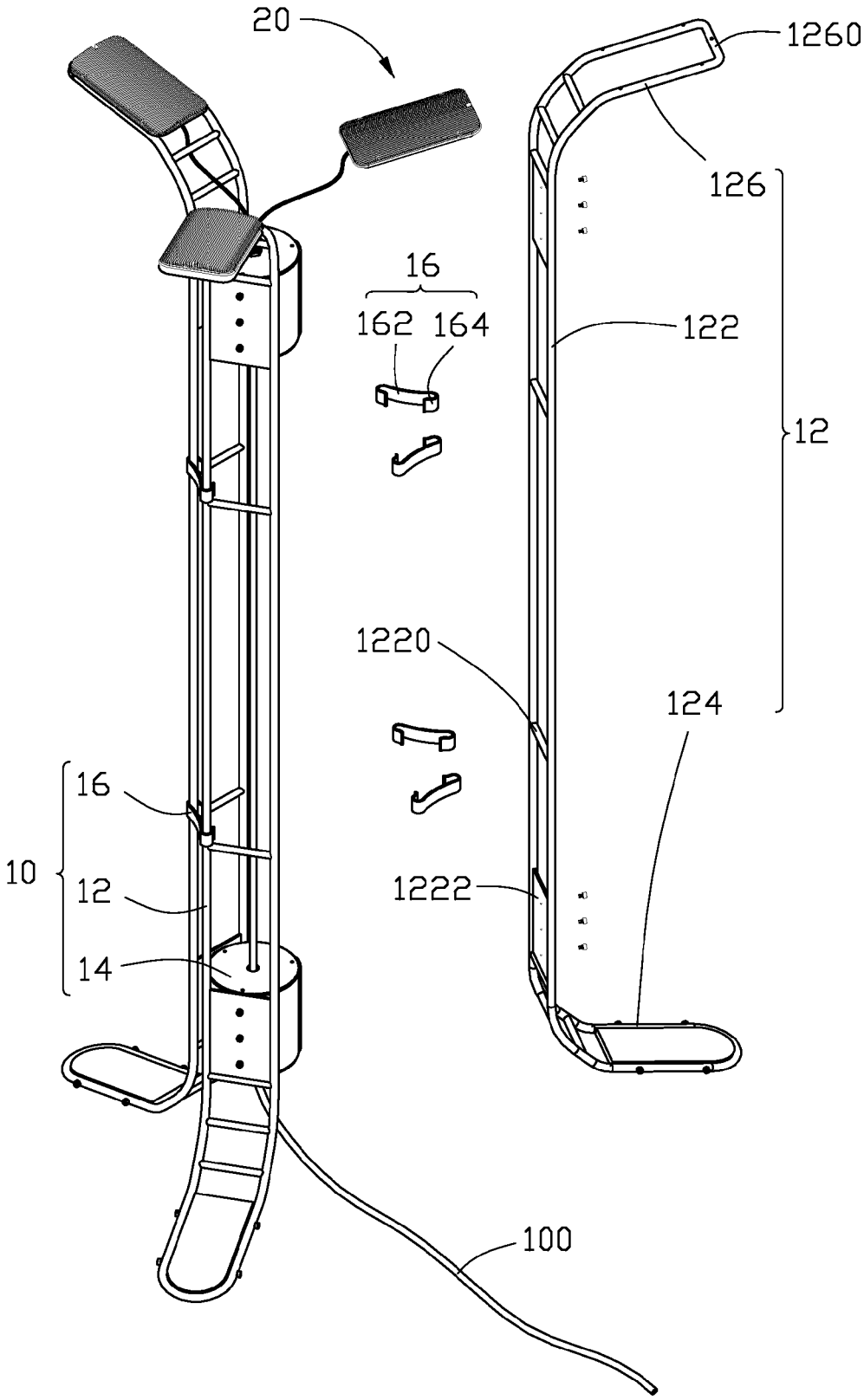
FIG. 2 is an exploded view of the LED lamp assembly of FIG. 1.

Referring to FIGS. 1-2, an LED lamp assembly in accordance with an exemplary embodiment is illustrated. The LED lamp assembly is configured to be directly placed on floor or ground to provide illumination, and be easily moveable. The LED lamp assembly comprises a fixing member 10 and a plurality of LED lamps 20 mounted on a top of the fixing member 10.

The fixing member 10 comprises a plurality of brackets 12, two spaced canisters 14 and a plurality of clips 16 fastening the brackets 12 together. The number of brackets 12 used is consistent with that of the LED lamps 20 and is three in this embodiment. Each bracket 12 is formed by two parallel metallic pipes or metallic wires connecting at opposite ends thereof. Each bracket 12 comprises a vertical part 122, a supporting part 124 extending outwards from a lower end of the vertical part 122 and a holding part 126 extending outwards from an upper end of the vertical part 122. A plurality of connecting poles 1220 are located between the two metallic pipes or wires and perpendicularly connected to the two metallic pipes or wires of the vertical part 122 to strengthen the brackets 12. Two spaced connecting plates 1222 are located between the two metallic pipes or wires and perpendicularly connected to the two metallic pipes or wires of the vertical part 122 to strengthen the brackets 12 and secure the canisters 14. The two canisters 14 are surrounded by the vertical parts 122 of the brackets 12 and abut corresponding inner sides of the connecting plates 1222 of the brackets 12, receiving relative electronic components such as selenium rectifier or controlling printed circuit board (not shown).

The supporting part 124 and the holding part 126 obliquely extend from two opposite ends of the vertical part 122 respectively and are at an obtuse angle to the vertical part 122. The holding part 126 of each bracket 12, formed by a round wire or pipe is rectangular and defines an opening (not labeled) therein receiving the LED lamp 20. A plurality of spaced engaging holes 1260 are defined in a top surface of the holding part 126 for securing the LED lamp 20 thereon.

The clips 16 are divided into two groups (i.e., upper and lower groups) spaced from each other. Each group includes three clips 16 clasping the brackets 12 together with each other. Each clip 16 is integrally formed by bending an elongated metallic sheet and comprises a connecting portion 162 and two hooks 164 bent inwardly from two opposite ends of the connecting portion 162.

In assembly of the fixing member 10, the two spaced canisters 14 abut the inner sides of the connecting plates 1222 of the brackets 12 and are secured to the brackets 12 by a plurality of screws (not labeled) extending through the connecting plates 1222 and then into the outer surfaces of the canisters 14. The clips 16 securely fasten every two neighboring vertical parts 122 of every two brackets 12, thus assembling the fixing member 10. The supporting parts 124 of the brackets 12 extend radially and outwards from the lower ends of the vertical parts 122 of the brackets 12, and are directly placed on a flat floor or ground surface while remaining fully moveable. The holding parts 126 of the bracket 12 extend radially and outwards from the upper ends of the vertical parts 122 of the brackets 12, thus enabling the LED lamp 20 to be mounted thereon to thereby provide a wider illumination area.

Figure 3:
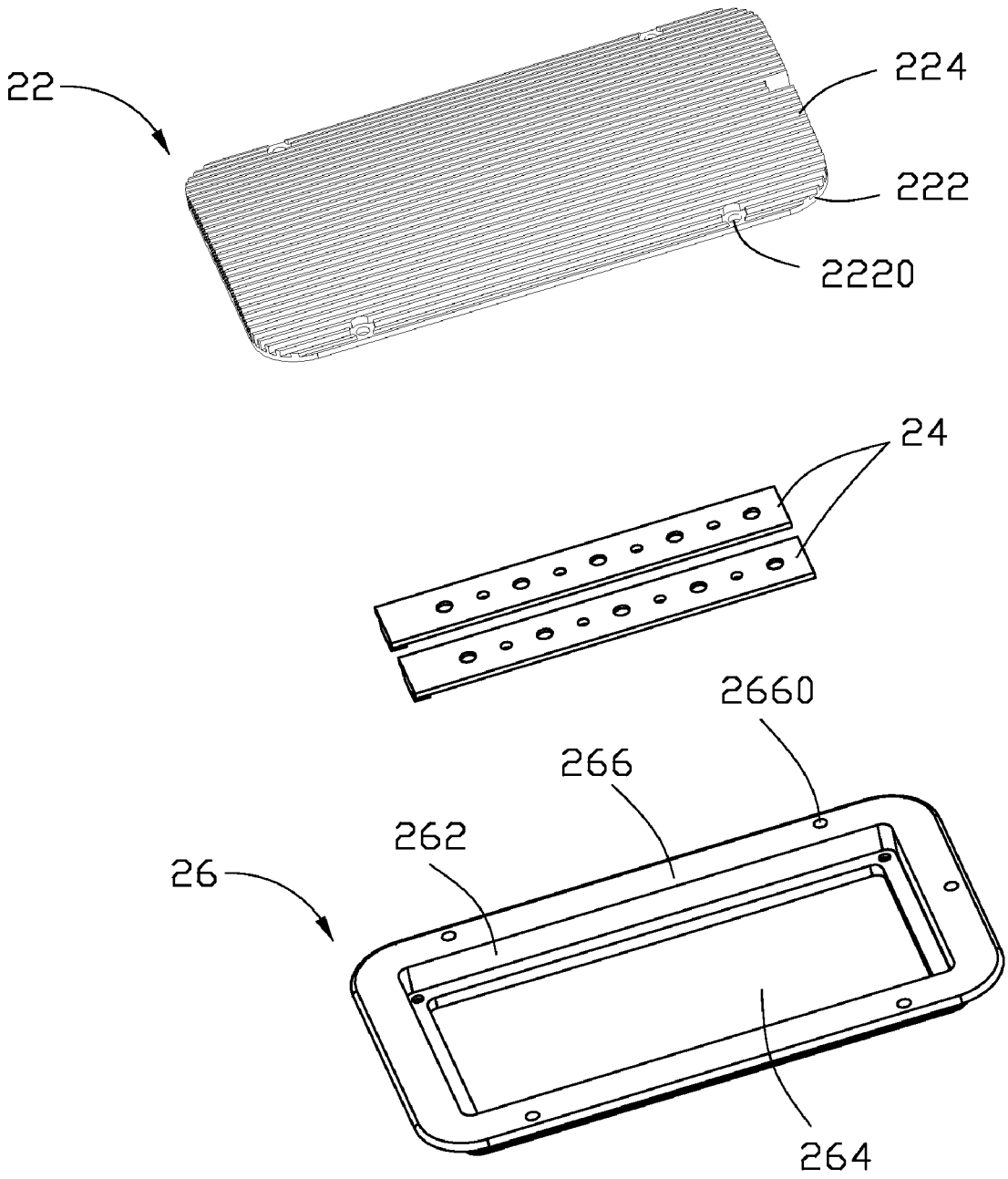
FIG. 3 is an exploded view of an LED lamp of FIG. 2.
Figure 4:
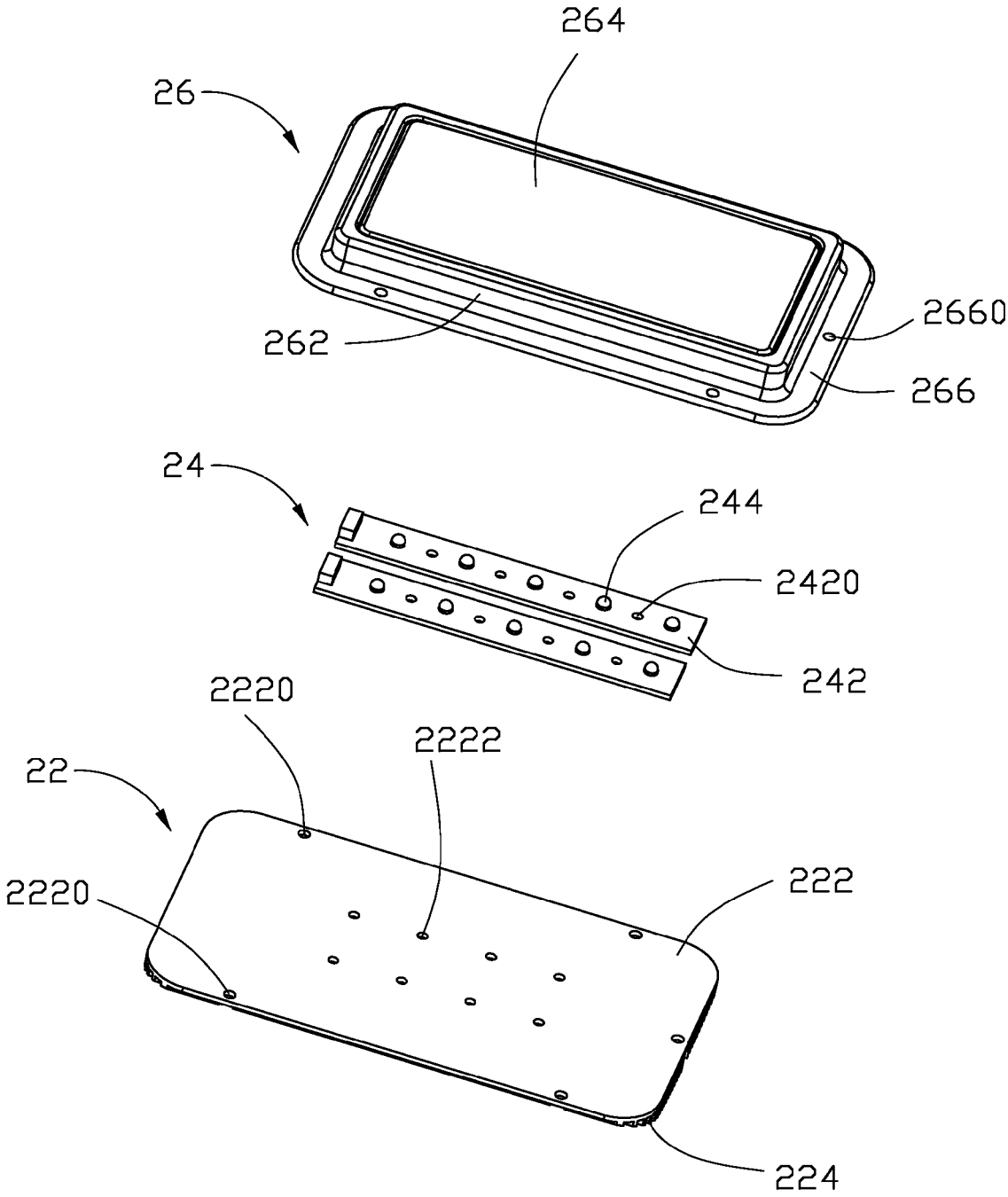
FIG. 4 is an inverted view of FIG. 3.

Also referring to FIGS. 3-4, each LED lamp 20 is secured to a corresponding mounting part 126 of the bracket 12 and faces downwardly through the opening thereof. Each LED lamp 20 comprises a heat sink 22 with a plurality of LED modules 24 attached to a bottom surface thereof, and a cover 26 engaging the heat sink 22 to enclose the LED modules 24.

The heat sink 22 is integrally formed of a material with high heat conductivity such as aluminum or copper and comprises a rectangular base plate 222 and a plurality of fins 224 extending upwardly from a top surface thereof. The base plate 222 is of similar size to the holding part 126 of the bracket 12 so as to be stably supported thereon. A plurality of extending holes 2220 are defined in the base plate 222 and adjacent to an edge of the base plate 222 for receiving screws (not shown) extending downwardly therethrough. A plurality of retaining holes 2222 are defined in a central part of the bottom surface of the base plate 222 and arranged in parallel lines for fixing the LED modules 24 on the bottom surface of the base plate 222. The fins 224 are perpendicular to the base plate 222 and parallel to two opposite longitudinal sides of the base plate 222.

The LED modules 24 are fixed on the bottom surface of the base plate 222 and arranged side by side. Each LED module 24 comprises an elongated printed circuit board 242 and a plurality of LEDs 244 mounted thereon. A plurality of through holes 2420 are defined in the printed circuit board 242 and respectively located between the two adjacent LEDs 244, allowing screws (not shown) extending therethrough to engage in the retaining holes 2222 of the base plate 222 of the heat sink 22 to fix the LED modules 24 to the heat sink 22.

The lamp cover 26 comprises a rectangular frame 262, a rectangular lens 264 mounted on a bottom of the frame 262 and covering the LED modules 24, and an annular engaging flange 266 extending outwards and horizontally from an upper end of the frame 262. The engaging flange 266 therein defines a plurality of mounting holes 2660 respectively in alignment with the extending holes 2220 of the base plate 222 of the heat sink 22.

In assembly of LED lamp assembly, the lamp covers 26 are respectively placed on the holding parts 126 of the fixing member 10. The frame 262 of the lamp cover 26 is snugly received in the opening of the holding part 126. The engaging flange 266 of the lamp cover is supported on the top of the holding part 126. The screws respectively extend through the extending holes 2220 of the heat sinks 22 and the mounting holes 2660 of the lamp covers 26 in sequence, and then into the corresponding engaging holes 1260 of the holding parts 126 of the fixing member 10 to thus securely couple the lamps 20 to the holding parts 126 in difference aspects of the fixing member 10. The lens 264 of the lamp covers 26 extend through the corresponding openings of the holding parts 126 of the fixing member 10 and are exposed downwardly. The LED modules 24 fixed to the bottom surfaces of the base plates 222 of the heat sinks 22 are respectively accommodated in the openings of the holding parts 126 of the fixing member 10 and surrounded by the holding parts 126.

In use, the LED lamps 20, facing different aspects of the fixing member 10 and angling upwardly from the vertical parts 122 of the fixing member 10, can generate light directed to different orientations around the fixing member 10 to thus evenly provide a broad illuminating area. Since the fixing member 10 of the LED lamp assembly is easily secured by directly placing the fixing member 10 on floor or ground, the LED lamp assembly is conveniently moved to any place. Heat generated by the LED modules 24 in use is quickly adsorbed by the base plate 222 of the heat sink 22, evenly distributed over the fins 224, and then dissipated to the exterior.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED (light emitting diode) lamp assembly comprising:

a fixing member having a plurality of supporting parts extending outwards from a bottom end thereof and a plurality of holding parts extending outwards from an upper end thereof, each holding part defining an opening therein; and a plurality of LED lamps respectively mounted on the holding parts of the fixing member, each LED lamp comprising a plurality of LED modules received in the opening of a corresponding holding part and facing toward the supporting parts.

2. The LED lamp assembly as claimed in claim 1, wherein the holding parts extend radially and symmetrically from the upper end of the fixing member and angle upwardly from the upper end of the fixing member.

3. The LED lamp assembly as claimed in claim 1, wherein the fixing member comprises a plurality of brackets and a plurality of clips fastening the brackets together, the holding parts and the supporting parts extending outwardly and laterally from two opposite ends of each of the brackets, respectively.

4. The LED lamp assembly as claimed in claim 3, wherein each bracket is integrally formed from two parallel pipes or wires interconnected at opposite ends thereof,.

5. The LED lamp assembly as claimed in claim 4, wherein the clips each comprise a connecting portion and two hooks from two opposite ends of the connecting portion, the two hooks of each clip engaging two neighboring brackets to thus fasten the two brackets together.

6. The LED lamp assembly as claimed in claim 5, wherein the fixing member comprises two spaced canisters and a plurality of vertical parts respectively connecting the holding parts and the supporting parts.

7. The LED lamp assembly as claimed in claim 6, wherein each vertical part has two spaced connecting parts connecting to a corresponding bracket, the connecting parts sandwiching the canisters therebetween.

8. The LED lamp assembly as claimed in claim 7, wherein the holding parts angle upwardly from the vertical parts, and each vertical part further comprises a plurality of connecting poles located between the two pipes or wires and connected to the two pipes or wires.

9. The LED lamp assembly as claimed in claim 1, wherein each LED lamp comprises a heat sink comprising a base plate supported on a top of a corresponding holding part and a plurality of fins extending upwardly from a top surface of the base plate, the LED modules fixed to a bottom surface of the base plate and surrounded by the corresponding holding part.

10. The LED lamp assembly as claimed in claim 9, wherein the each LED lamp further comprises a lamp cover embedded in a top of the corresponding holding part and sandwiched between the holding part and the base plate of the heat sink.

11. The LED lamp assembly as claimed in claim 10, wherein the lamp cover comprises a frame received in the opening of the corresponding holding part, a lens mounted on a bottom end of the frame and covering the LED modules, and an engaging flange extending outwards and horizontally from an upper end of the frame, the lens being located below the opening of the corresponding holding part, the engaging flange being sandwiched between the corresponding holding part and the base plate.

* * * * *